US005114652A

United States Patent [19]

Lee

[11] Patent Number: 5,114,652

[45] Date of Patent: May 19, 1992

[54] PROCESS FOR MAKING COLORED ARAMID FIBERS

[75] Inventor: Kiu-Seung Lee, Richmond, Va.

[73] Assignee: E. I. du Pont de Nemours and Company, Wilmington, Del.

[21] Appl. No.: 595,837

[22] Filed: Oct. 11, 1990

Related U.S. Application Data

[62] Division of Ser. No. 226,645, Aug. 1, 1988, Pat. No. 4,994,323.

[51] Int. Cl.[5] ..... D01F 1/04; D01F 6/60

[52] U.S. Cl. ..... 264/184; 264/210.3; 264/210.6; 264/210.8; 264/211; 264/211.15; 264/211.16

[58] Field of Search ..... 264/184, 210.8, 211, 264/25, 38, 205, 211.15, 211.16, 210.3, 210.6

[56] References Cited

U.S. PATENT DOCUMENTS

| | | | |
|---|---|---|---|
| 3,558,267 | 1/1971 | Langenfeld | 8/172 |
| 3,591,327 | 7/1971 | Matsuda et al. | 8/166 |
| 3,630,662 | 12/1971 | Brody et al. | 8/172 |
| 3,713,769 | 1/1973 | Beal et al. | 8/173 |
| 3,767,756 | 10/1973 | Blades | 524/422 |
| 3,869,429 | 3/1975 | Blades | 260/78 S |
| 3,888,821 | 6/1975 | Milford, Jr. | 260/45.8 NT |
| 4,059,403 | 11/1977 | Wolf et al. | 8/168 |
| 4,144,023 | 3/1979 | Provost | 8/925 |
| 4,198,494 | 4/1980 | Burckel | 525/425 |
| 4,320,081 | 3/1982 | Lammers | 264/184 |
| 4,419,317 | 12/1983 | Fujiwara et al. | 264/184 |
| 4,524,168 | 6/1985 | Wick | 524/190 |
| 4,705,527 | 11/1987 | Hussamy | 8/925 |
| 4,759,770 | 7/1988 | Cates et al. | 8/925 |

FOREIGN PATENT DOCUMENTS 1438067 6/1976 United Kingdom .

*Primary Examiner*—Hubert C. Lorin

[57] ABSTRACT

Colored, high strength, high modulus p-aramid fibers are prepared by including an organic pigment which is soluble in but not degraded by concentrated sulfuric acid in a p-aramid spinning dope wherein the solvent is concentrated sulfuric acid and spinning the pigment containing dope through an air gap into a coagulation bath and washing and drying the resulting fibers. The dissolved pigment is precipitated by the coagulation bath as particles with a diameter of less than 0.50 microns.

3 Claims, 4 Drawing Sheets

1μ

1 μ

1 μ

1 μ

PROCESS FOR MAKING COLORED ARAMID FIBERS

This is a division of U.S. patent application Ser. No. 07/226,645 filed Aug. 1, 1988 now U.S. Pat. No. 4,994,323 issued Feb. 19, 1991.

FIELD OF INVENTION

This invention relates to colored, high strength, high modulus p-aramid fibers and a process for preparing them.

High strength, high modulus p-aramid fibers are known from U.S. Pat. No. 3,869,429 (Blades). These fibers are extremely difficult to dye. Some improvement in dyeability can be obtained by mechanically crimping these fibers while wet but dye penetration is limited to the crimp nodes of the individual filaments and the mechanical properties of the fibers are degraded.

Colored p-aramid fibers of relatively low strength and modulus are known from U.S. Pat. No. 3,888,821 and British Patent 1,438,067. These patents disclose the wet spinning of poly(p-phenylene terephthalamide) from sulfuric acid solutions which also contain dissolved dyes. The dyes used are vat dyes or copper phthalocyanine pigment.

BRIEF DESCRIPTION OF THE INVENTION

This invention provides colored high strength, high modulus p-aramid fibers having colorant particles or agglomerates with a diameter of from about 0.01 to 0.50 microns The fibers are colored with a completely organic pigment. The organic pigment is at least one selected from the group consisting of (1) monoazo and disazo pigments, (2) anthanthrone pigments, (3) indanthrone pigments, (4) pyranthrone pigments, (5) vilanthrone pigments, (6) flavanthrone pigments, (7) quinacridone pigments, (8) dioxazine pigments, (9) indigoid and thioindigoid pigments, and (10) isoindolinone pigments.

Monoazo and disazo pigments have the structure

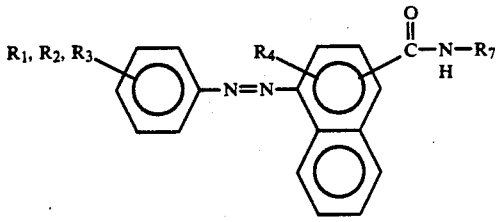

wherein $R_1$, $R_2$ and $R_3$ are chloro, nitro, methyl, methoxy, or hydrogen, $R_4$ is hydroxy, and $R_7$ is

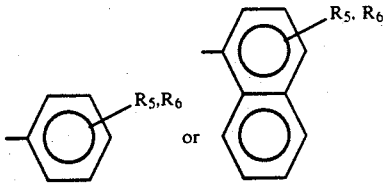

wherein $R_4$ and $R_6$ are hydrogen, methyl, or chloro.

Anthanthrone pigments have the structure

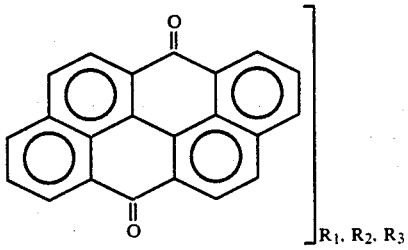

wherein $R_1$, $R_2$ and $R_3$ are —H, —Cl, or —Br.

Indanthrone pigments have the structure

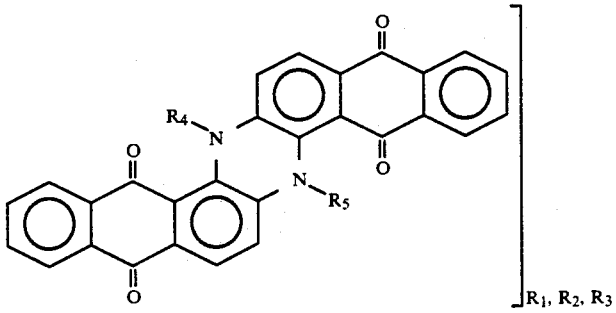

wherein $R_1$, $R_2$ and $R_3$ are —H, —OH, —Cl, —Br, —$NH_2$,

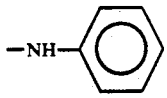

or fused aromatic groups, $R_4$ and $R_5$ and —H, —$CH_3$, or —$C_2H_5$.

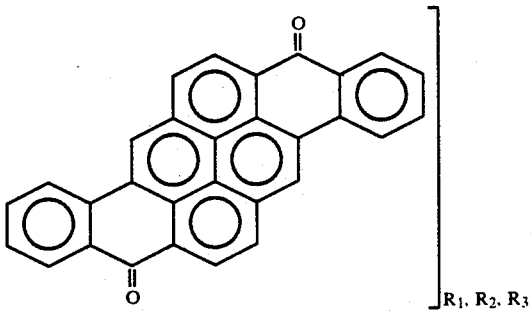

wherein $R_1$, $R_2$ and $R_3$ are —H, —Cl, or —Br.

Vilanthrone pigments have the structure

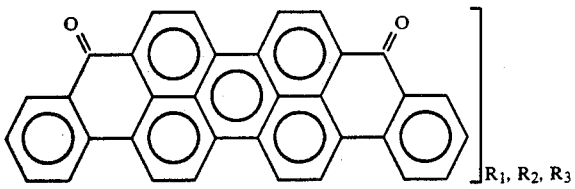

wherein $R_1$, $R_2$, and $R_3$ are —H, —Cl, —Br, —$OCH_3$, —$OC_2H_5$,

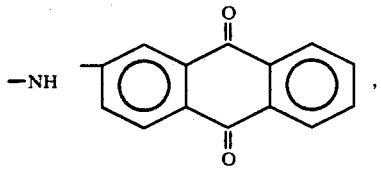

Flavanthrone pigments having the structure

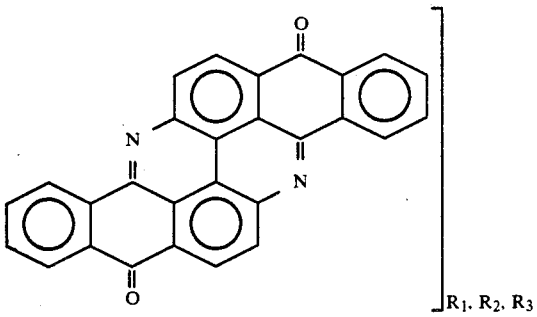

wherein $R_1$, $R_2$ and $R_3$ are —H, —Cl, —Br, —OH, an aromatic group or a fused aromatic group.

Quinacridone pigments have the structure

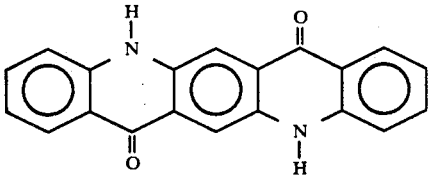

Dioxazine pigments have the structure

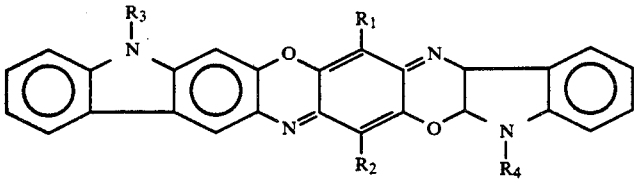

wherein $R_1$ and $R_2$ are —H or —Cl and $R_3$ and $R_4$ are —$CH_3$ or —$C_2H_5$.

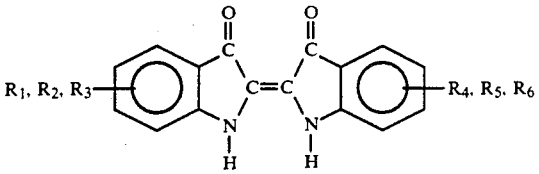

wherein $R_1$, $R_2$, $R_3$, $R_4$, $R_5$ and $R_6$ are —H, —Cl, —Br, —Chphd 3 or —$NH_2$ and thioindigoid pigments have the structure

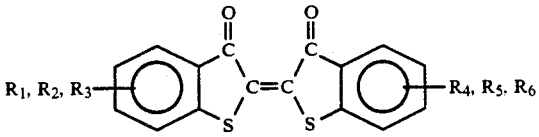

wherein $R_1$, $R_2$, $R_3$, $R_4$, $R_5$ and $R_6$ are —H, —Cl, —$NH_2$, —$OC_2H_5$, —$SC_2H_5$, —$CH_3$, —$OCH_3$, phenyl or fused aromatic groups.

Isoindolinone pigments have the structure

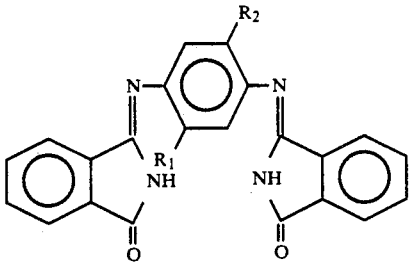

The preferred monoazo pigment is Colour Index Pigment Red 3. The preferred disazo pigment is Colour Index Pigment Red 242. The preferred anthanthrone pigment is Colour Index Pigment Red 168. The preferred indanthrone pigment is Colour Index Pigment Blue 60. The preferred pyranthrone pigment is Colour Index Pigment Orange 40. The preferred vilanthrone pigment is Colour Index Pigment Blue 65. The preferred flavanthrone pigment is Colour Index Yellow 24. The preferred quinacridone pigment is Colour Index Pigment Red 122. The preferred dioxazine pigment is Colour Index Pigment Violet 23. The preferred indigoid and thioindigoid pigments are Colour Index Pigment Red 88 and Colour Index Pigment Red 86, respectively. The most preferred isoindolinone pigment is Colour Index Pigment Yellow 173.

The organic pigments of the foregoing structures are those pigments named in the Colour Index published by the Society of Dyers and Colourists.

The colored high strength, high modulus p-aramid fibers of this invention have visible colorant particles when viewed under an electron microscope. The particles or agglomerates are consistently smaller than about 0.50 in diameter. Above about 0.50 microns in diameter, particles cause a decrease in the tenacity attainable; and, as particles increase in size, tensile strength decreases further. The fibers have a yarn tenacity of at least 18 gpd (15.9 dN/tex) and an initial modulus of at least 400 gpd (354 dN/tex). Filament tenacity is often higher, by as much as 3 gpd (2.6 dN/tex).

This invention also provides a process for the preparation of the colored, high strength, high modulus p-aramid fibers comprising the steps of (1) agitating a mixture of sulfuric acid soluble organic pigment in an amount sufficient to provide the desired color intensity and sufficient p-aramid polymer having an inherent viscosity of at least 4 to provide a polymer solution having a concentration of at least 18% by weight in cold concentrated sulfuric acid having a concentration of at least 98%, (2) heating the mixture with continued agitation to a temperature of 80° to 105° C. whereby a uniform solution is obtained, (3) extruding the solution through a spinneret and then passing it through a non-coagulating fluid layer such that the spin stretch factor for the extrudate is 3 to 10, (4) passing the extrudate into an aqueous coagulation bath having a temperature of −5° to 25° C., and (5) washing the newly formed filaments with water and/or dilute alkali.

The spin stretch factor is the ratio of the velocity of the filaments as they leave the coagulating bath to the velocity of the extrudate as it leaves the spinneret.

DETAILED DESCRIPTION OF THE INVENTION

Figure 1:
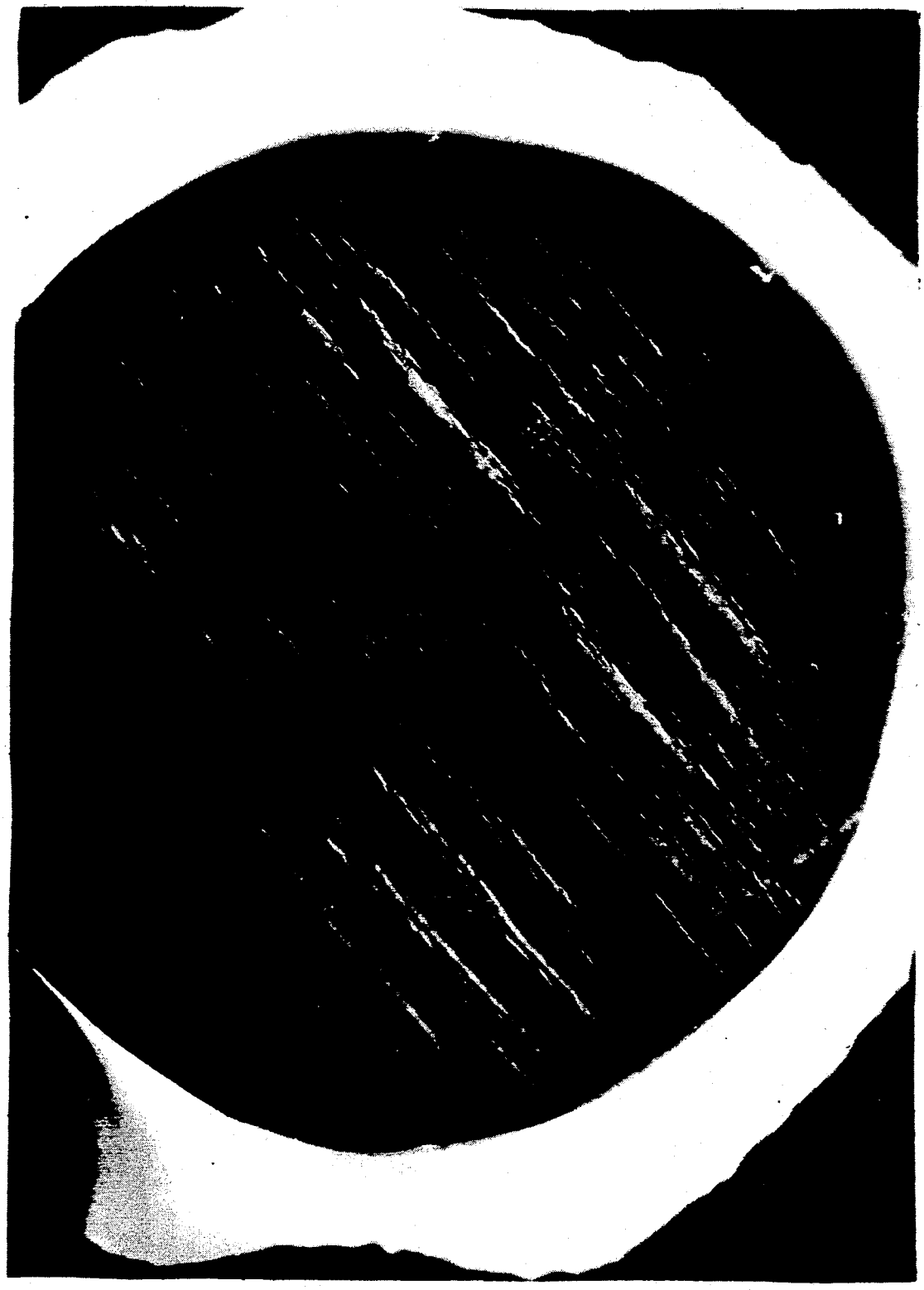

The para-oriented aromatic polyamides (p-aramids) useful in the present invention are those described in U.S. Pat. No. 3,869,429 in which rigid radicals are linked into polymer chains by amide groups. The chain-extending bonds of the rigid radicals are either coaxial or parallel and oppositely directed. The rigid radicals may be single-ring radicals, multi-ring radicals in which the chain-extending bonds are para-oriented, fused ring radicals or heterocyclic radicals. Preferred rigid radicals are 1,4-phenylene, 2,6-naphthalene, 1,5-naphthalene, 4,4'-bihphenylene, trans-1,4-cyclohexylene, trans-trans-4,4'-bicyclohexylene, 1,4-pyridylene and 1,4-phenylene groups linked by trans-vinylene, ethynylene, azo or azoxy groups. The polyamides may be substituted with simple groups such as chloro- and methyl groups. Both homopolymers and copolymers are suitable as long as the rigid radicals are as defined above. Up to 5 mol percent of non-conforming radicals may be included.

The polyamides may be prepared by reaction of a suitable aromatic acid halide with a suitable aromatic diamine in a non-reactive amide solvent which may contain solubilizing salts such as LiCl or $CaCl_2$. The polyamide should have an inherent viscosity of at least 4.

By high strength is meant a yarn or filament tenacity of at least 18 gpd (15.9 dN/tex). By high modulus is meant having a yarn or filament initial modulus of at least 400 gpd (354 dN/tex). The single fibers of the present invention usually have a denier of 0.5 to 15 but such is not critical.

The purely organic pigments suitable for use in the present invention are soluble in sulfuric acid having a concentration of at least 98%, but are insoluble in water or organic solvents and do not degrade appreciably in 98% sulfuric acid at 95° C. when held at that temperature for three hours. Indications of pigment degradation include change of color in the final fiber, bleeding of the pigment into the coagulation bath and precipitation of the pigment from the polymer solution. The amount of organic pigment will depend on the tint desired and the type of organic pigment used but in general 0.01 to 6% by weight pigment in the fibers provides useful results. Suitable organic pigments may show a change in color when dissolved in concentrated sulfuric acid but will return to the original color on coagulation and washing of the fibers. The chemical structures of preferred organic pigments have been defined above. Organic pigments with an inorganic component are generally unsatisfactory.

It has been found that some vat dyes may, also, dissolve in sulfuric acid spinning solutions without severe degradation, and some such spinning solutions may be spun to yield fibers having extremely small particles of vat dyes therein—on the order of less than 0.01 microns. In contrast to the purely organic pigments of the present invention, however, vat dyes have been found to interfere with the crystal structure of the fibers and to cause a severe decrease in fiber tenacity.

In the process of this invention, sufficient p-aramid polymer having an inherent viscosity of at least 4.0 is mixed with cold sulfuric acid having a concentration of at least 98% and the desired amount of sulfuric acid soluble organic pigment to provide, when heated, a dope having a p-aramid concentration of at least 18% by weight. The dope is heated to 80°-105° C. with stirring and degassed. The hold-up time of the dope may be 1-3 hours in a commercial spinning process. The dope is extruded through a spinneret having orifices with a diameter of 0.025 to 0.125 mm through a layer of non-coagulating fluid, usually air, into an aqueous coagulating bath having a temperature of −5° to 25° C. The air gap may be from 0.5 to 2.5 cm but preferably is about 0.7 cm. The yarn is further washed with dilute alkali and/or water and wound up on bobbins. The fibers are of the same color as the original organic pigment added. No color is lost to the aqueous coagulation bath.

Measurements and Tests

Linear Density

This is usually calculated as denier, that is, the weight in grams of a 9000-meter length of yarn. Multiplication of denier by 1.1111 yields linear density in dtex.

Tensile Properties

Tenacity is reported as breaking stress divided by linear density. Modulus is reported as the slope of the initial stress/strain curve converted to the same units as tenacity. Elongation is the percent increase in length at break. Both tenacity and modulus are first computed in g/denier units which, when multiplied by 0.8826, yield dN/tex units). Each reported measurement is the average of 10 breaks.

Tensile properties for yarns are measured at 24° C. and 55% relative humidity after conditioning under the test conditions for a minimum of 14 hours. Before testing, each yarn is twisted to a 1.1 twist multiplier (for example, nominal 1500 denier yarn is twisted about (0.8 turns/cm). Each twisted specimen has a test length of 25.4 cm and is elongated 50% per minute (based on the original unstretched length) using a typical recording tress/strain device.

Tensile properties for filaments are measured at 21° C. and 65% relative humidity after conditioning under test conditions for a minimum of 14 hours. A single filament is mounted to provide a test length of 2.54 cm rsing 3B Pneumatic Action Clamps with neoprene faces (available from Instron Corp.). Rate of elongation is 10% per min. Tensile properties of filaments are normally at least as large as the properties for yarns.

Inherent Viscosity

Inherent viscosity ($\eta_{inh}$) *is measured at* 30° C. and computed from $$\eta_{inh} = ln(t_1/t_2)/c$$

where $t_1$ = solution flow time in the viscometer $t_2$ = solvent flow time in the viscometer c = polymer concentration of 0.5 g/dL, and the solvent is concentrated sulfuric acid (95–99 wgt %).

Twist Multiplier

The twist multiplier (TM) correlates twist per unit of length with linear density of a yarn being twisted. It is computed from $$TM = (Denier)^{\frac{1}{2}}(tpi)/73$$

where tpi = turns/in $$TM = (dtex)^{\frac{1}{2}}(tpc)/30.3$$

where tpc = turns/cm

Particle Size

The fibers of this invention have colorant particles or agglomerates with a diameter consistently smaller than about 0.50.

EXAMPLE 1

Sulfuric acid having a concentration of 100.1% (24,235 g) was cooled in a reaction vessel to −5° C. by a circulating −25° C. glycol jacket. Poly(p-phenylene terephthalamide) having an inherent viscosity of 6.3 (5,889 g) and Sandorin Blue RL (Pigment Blue 60) powder (176.7 g) were added to the reaction vessel. The mixture was stirred while the temperature was gradually increased to 85° C. The mixture was stirred for two hours at 85° C. under a reduced pressure of 25 mm (Hg) to eliminate air bubbles. The resulting dope was extruded through a filter pack and then through a 267 hole spinneret having spinning capillaries 0.063 mm in diameter, and finally through an air gap of 0.7 cm length into an aqueous coagulating bath at 5° C. The extruded dope was stretched 6.3 × in the air gap. The resulting fibers were further washed with dilute aqueous alkali and water, dried on a roll at 180° C. and wound up at 732 m/min. No color was lost to the coagulating bath. Pigment level was 3% based on weight of fiber. Yarn tenacity/elongation/modulus/filament linear density was 21.0 gpd/2.63%/764 gpd/1.5 den (18.1 dN/tex/2.63%/675 dN/tex/1.7 dtex). Corresponding filament properties were 21.0 gpd/3.98%/612 gpd/1.5 den (18.6 dN/tex/3.98%/541 dN/tex/1.7 dtex). An identical spin except without added organic pigment resulted in yarns having tenacity/elongation/modulus of 21.5 gpd/2.81%/680 gpd (19.0 dN/tex/2.81%/601 dN/tex).

EXAMPLE 2 AND COMPARATIVE EXAMPLE 1

A spin identical with Example 1, above, except using 4% of the Sandorin Blue RL pigment, based on weight of the fiber, resulted in yarns having tenacity/elongation/modulus of 18.3gpd/2.6%/674gpd (16.1 dN/tex/2.6%/595 dN/tex).

As a comparison, a spin was, also, conducted identical with Example 1, above, except using 4% of a vat dye identified as C.I. Vat Violet 1. The fibers from that spin had tenacity/elongation/modulus of 15.5gpd/3.1%/516gpd (13.7 dN/tex/3.1%/456 dN/tex).

To further determine differences between the pigmented fibers of Example 2 and the dyed fibers of Comparative Example 1, it was determined that the Orientation Angle (OA) and the Apparent Crystallite Size (ACS) for those fibers and for a control fiber made according to Example 1 but with no color additives, exhibited the following qualities:

| Fiber | OA (deg) | ACS (Å) |
|---|---|---|
| Control | 11.9 | 53.5 |
| Example 2 | 11.6 | 53.7 |
| Comparative Ex. 1 | 19.7 | 47.1 |

Orientation Angle and Apparent Crystallite Size are determined as described in U.S. Pat. No. 3,869,429. Lower Orientation Angle values indicate higher degrees of polymer orientation and increased tensile strengths.

To observe the differences between fibers having the pigment of this invention and fibers having dye, photomicrographs were made of the fiber product of this example and comparative example. Sample fibers were embedded in an epoxy resin, cut using an ultra microtome along a direction at 45 degrees to the fiber axis into a 2000 Å thick specimen, and examined on a cut surface using an electron microscope at 500–10000 × total magnification. Sections were, also, made in the longitudinal direction (along the fiber axis).

FIG. 1 is a photomicrograph of a cross-section of the fiber of this example with Sandorin Blue pigment. The dark spots in the cross-section are particles of pigment which precipitated from its initial solution in the spinning dope on contact with the coagulation bath after spinning was complete. The particles, while apparently only relatively few in number, represent a part of the pigment concentration which serves to give the fibers a brilliant blue appearance. The pigment particles which are visible are a uniform 0.1 micron in diameter.

Figure 2:
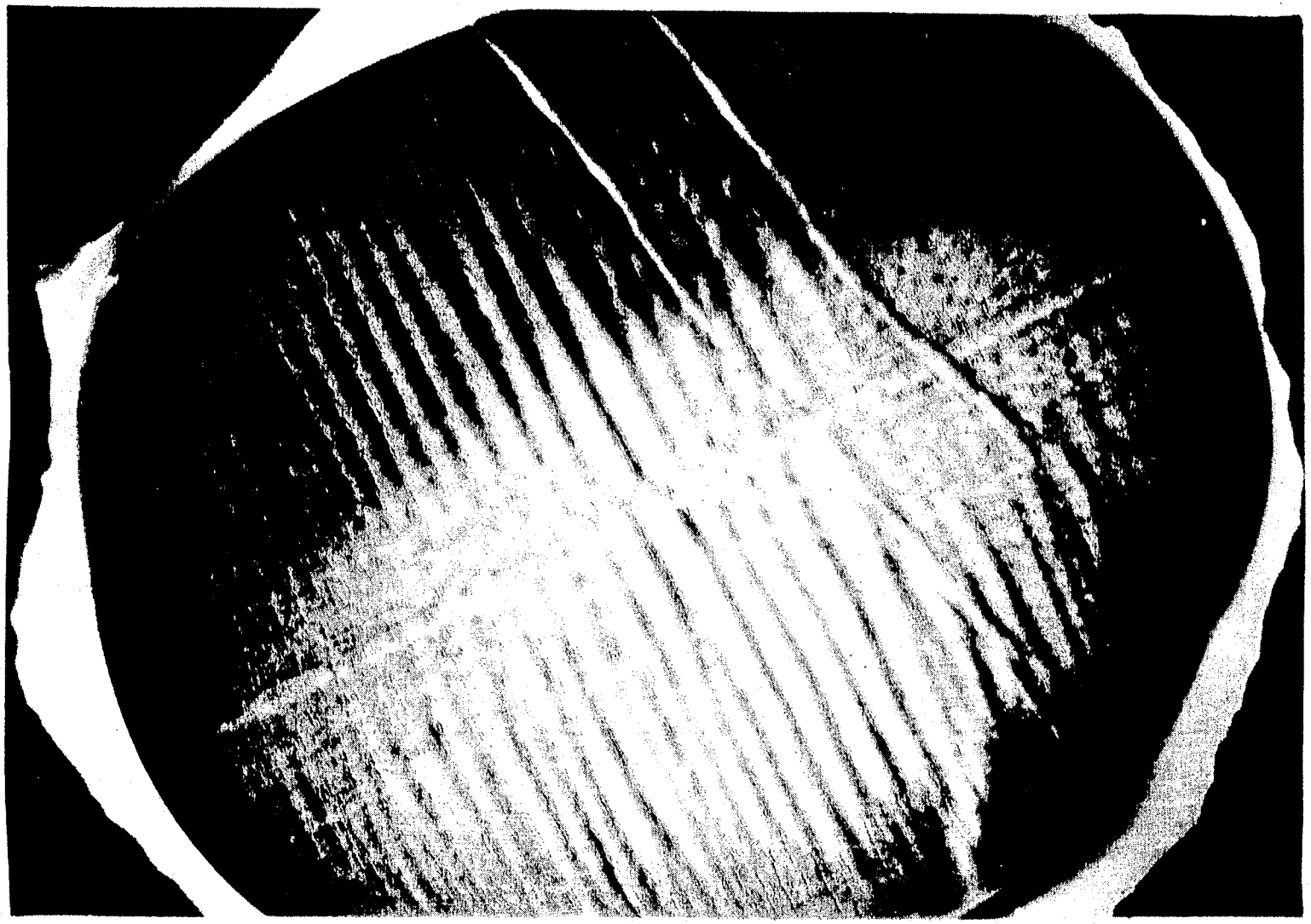

FIG. 2 is a photomicrograph of a cross-section of the fiber of this comparative example with the C.I. Vat Violet 1 vat dye. There are no particles evident in the photograph It is not understood what mechanism explains this; but, because significant loss in tenacity occurred, it is probable that the dye became bound to the polymer in such a way as to disrupt crystallization to some extent.

Figure 3:
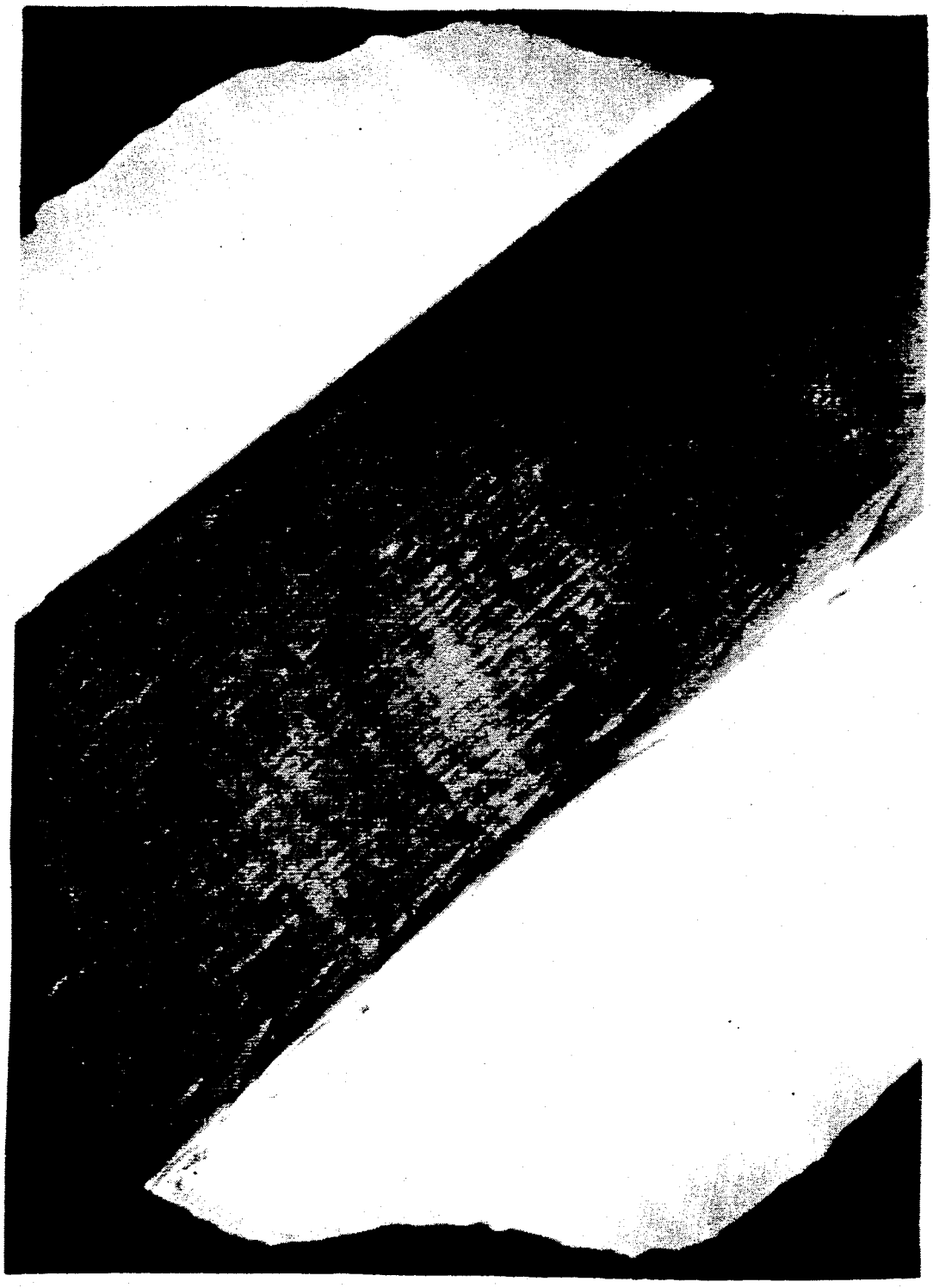
Figure 4:
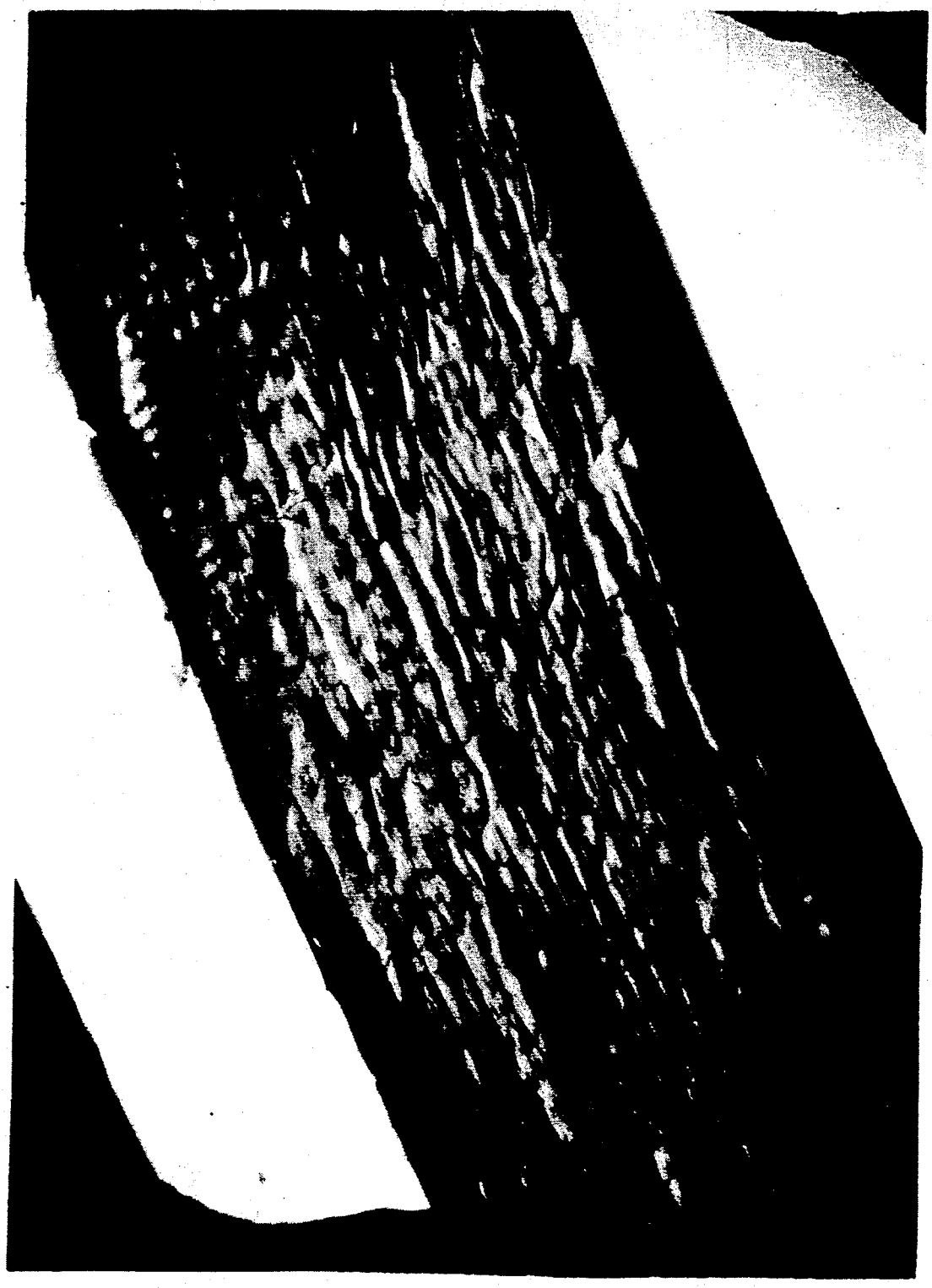

FIGS. 3 and 4 are photomicrographs of longitudinal sections of the fibers of this example and comparative example, respectively. The observations are the same as for FIGS. 1 and 2.

EXAMPLES 3–7

Example 1 was repeated except for the amounts and kinds of organic pigments used and windup speed and denier changes as noted. The results are summarized in Tables 1 and 2.

In addition to results shown in the Tables for the fiber of Example 6, filament properties were also determined on that product after crimping. A 0.75 inch (1.9 cm) stuffer box crimper was used with a feed rope of 84,000 denier (93,300 dtex) fed at 175 ypm (160 mpm) using steam in the stuffer box at 12 psig (83 kPa gage) and a clapper-gate pressure of 20 psig (138 kPa gage). The T/E/M results were 17.0 gpd/5.19%/270 gpd (15.0 dN/tex/5.19%/239 dN/tex).

COMPARATIVE EXAMPLES 2–4

Example 1 was repeated except for the amounts and kinds of pigment used. The results are summarized in the Tables 1 and 2, using C-2 to C-4 for identification.

Photomicrographs of the fiber cross-section showed large pigment particles distributed nonuniformly throughout the cross-section. Average size was larger than 1 micron. Pigment Black 7 is carbon black which is insoluble in concentrated sulfuric acid. Pigment White 3 is titanium dioxide which is also insoluble in concentrated sulfuric acid. Pigment Green 7 is a copper-phthalocyanine pigment which is degraded by concentrated sulfuric acid with precipitation of copper sulfate. Some vat dyes are soluble in concentrated sulfuric acid but bleed out in the coagulation bath, chemically interact with the fiber polymer to reduce tenacity and/or become degraded in the concentrated sulfuric acid. Vat Orange 2 and Vat Black 27 were found to be chemically unstable in sulfuric acid.

TABLE 1

| | | | | Yarn Properties | | | | |
|---|---|---|---|---|---|---|---|---|
| | | | | Tenacity | | E- | Modulus | |
| Example # | Pigments | Pigment Level | Wash-out | gpd | dN/tex | long. % | gpd | dN/tex |
| 3 | Red 242 | 1% | No | 21.5 | 19.0 | 2.66 | 753 | 666 |
| 4 | Blue 60 | 0.3% | No | 19.6 | 17.3 | 2.58 | 701 | 620 |
| | Yellow 24 | 0.2% | | | | | | |
| 5 | Red 242 | 4% | No | 18.1 | 16.0 | 2.46 | 681 | 602 |
| 6* | Blue 60 | 1.5% | No | 23.2 | 20.5 | 2.50 | 700 | 619 |
| | Red 242 | 0.3% | | | | | | |
| | Yellow 24 | 0.05% | | | | | | |
| 7* | Violet 23 | 1.0 | No | 23.3 | 20.6 | 2.62 | 685 | 605 |
| Control (732 mpm) | | 0 | | 21.5 | 19.0 | 2.81 | 680 | 601 |
| Control* | | 0 | | 23.5 | 20.8 | 2.72 | 685 | 605 |
| C-2** | Black 7 | 4% | No | 14.6 | 12.9 | 2.35 | 612 | 541 |
| C-3** | White 3 | 1% | No | 13.8 | 12.2 | 2.48 | 560 | 495 |
| C-4*** | Green 7 | 0.45% | Yes | 14.0 | 12.4 | 2.38 | 593 | 524 |

TABLE 1-continued

| | | | | Yarn Properties | | | | |
|---|---|---|---|---|---|---|---|---|
| | | | | Tenacity | | E- | Modulus | |
| Example # | Pigments | Pigment Level | Wash-out | gpd | dN/tex | long. % | gpd | dN/tex |

*Spun at 594 mpm 1500 denier (1667 dtex).
**Spinneret pressure increases rapidly, blinding the filters.
***Spinneret pressure was already high at beginning of test. Degraded pigment bleeds out to the coagulating bath.

TABLE 2

| | | Filament Properties | | | | |
|---|---|---|---|---|---|---|
| | | Tenacity | | Elong. | Modulus | |
| Example # | Pigments | gpd | dN/tex | % | gpd | dN/tex |
| 3 | Red 242 | 22.4 | 19.8 | 4.02 | 582 | 514 |
| 4 | Blue 60 | 18.0 | 15.9 | 3.71 | 500 | 442 |
| | Yellow 24 | | | | | |
| 5 | Red 242 | 18.3 | 16.2 | 3.76 | 519 | 459 |
| 6* | Blue 60 | 22.0 | 19.4 | 5.57 | 430 | 380 |
| | Red 242 | | | | | |
| | Yellow 24 | | | | | |
| 7* | Violet 23 | 24.4 | 21.6 | 5.15 | 502 | 444 |
| Control (732 mpm) | | 22.0 | 19.4 | 4.43 | 509 | 450 |
| Control* | | 25.4 | 22.4 | 5.92 | 445 | 393 |
| C-2** | Black 7 | 14.3 | 12.6 | 3.05 | 489 | 432 |
| C-3** | White 3 | 14,8 | 13.1 | 3.28 | 502 | 444 |
| C-4*** | Green 7 | N.A.+ | — | N.A. | N.A. | — |

*Spun at 594 mpm 1500 denier (1667 dtex).
**Spinneret pressure increases rapidly, blinding the filters.
***Spinneret pressure was already high at beginning of test. Degraded pigment bleeds out to the coagulating bath.
+N.A. = not available.

What is claimed is:

1. A process for preparation of high strength, high modulus p-aramid fibers comprising the steps of:
   a) agitating a mixture of:
      i) sulfuric acid having a concentration of at least 98%;
      ii) p-aramid polymer having an inherent viscosity of at least 4 in an amount which is at least 18 weight percent of the mixture; and
      iii) completely organic, sulfuric acid soluble, pigment in an amount which is from 0.01 to 6 weight percent based on the p-aramid polymer;
   b) heating the mixture with continued agitation to a temperature of 80° to 105° C. to form a uniform solution;
   c) extruding the solution through a spinneret;
   d) passing the extruded solution through a non-coagulating fluid layer 0.5 to 2.5 centimeters thick such that the spin stretch factor is 3 to 10;
   e) passing the stretched solution into and through an aqueous coagulating bath having a temperature of −5° to 25° C. to form filaments; and
   f) washing the filaments with a liquid selected from the group consisting of water and dilute aqueous alkali.

2. Process of claim 1 wherein the p-aramid is poly(p-phenylene terephthalamide).

3. Process of claim 1 wherein the organic pigment is selected from the group consisting of (1) monoazo or disazo pigments, (2) anthanthrone pigments, (3) indanthrone pigments, (4) pyranthrone pigments, (5) vilanthrone pigments, (6) flavanthrone pigments, (7) quinacridone pigments, (8) dioxazine pigments, (9) indigoid and thioindigoid pigments and (10) isoindolinone pigments.

* * * * *